US008206640B2

(12) United States Patent
Vakili et al.

(10) Patent No.: US 8,206,640 B2
(45) Date of Patent: Jun. 26, 2012

(54) PROCESS FOR COLLECTION OF CONTINUOUS FIBERS AS A UNIFORM BATT

(75) Inventors: Ahmad D. Vakili, Tullahoma, TN (US); Daniel F. Rossillon, Ponca City, OK (US)

(73) Assignee: The University of Tennessee Research Foundation, Knoxville, TN (US)

( * ) Notice: Subject to any disclaimer, the term of this patent is extended or adjusted under 35 U.S.C. 154(b) by 1035 days.

(21) Appl. No.: 10/565,791

(22) PCT Filed: Jul. 26, 2004

(86) PCT No.: PCT/US2004/023864

§ 371 (c)(1),
(2), (4) Date: Aug. 10, 2006

(87) PCT Pub. No.: WO2005/012619

PCT Pub. Date: Feb. 10, 2005

(65) Prior Publication Data

US 2006/0273483 A1 Dec. 7, 2006

(51) Int. Cl.
*D01D 5/098* (2006.01)
*D04H 3/03* (2006.01)

(52) U.S. Cl. ..... 264/555; 264/103; 264/210.8; 264/211.14

(58) Field of Classification Search ..... 264/103, 264/210.8, 211.14, 555
See application file for complete search history.

(56) References Cited

U.S. PATENT DOCUMENTS

| | | | | |
|---|---|---|---|---|
| 3,324,906 | A | 6/1967 | Franke | |
| 5,599,488 | A | 2/1997 | Profee | |
| 5,648,041 | A * | 7/1997 | Rodgers et al. | 264/555 |
| 5,766,646 | A | 6/1998 | Geus et al. | |

FOREIGN PATENT DOCUMENTS

| | | | |
|---|---|---|---|
| EP | 1 170 411 | A | 1/2002 |
| WO | 96/35009 | A | 11/1996 |
| WO | 97/05306 | A | 2/1997 |

* cited by examiner

*Primary Examiner* — Leo B Tentoni
(74) *Attorney, Agent, or Firm* — Johnson, Marcou & Isaacs, LLC; Jason M. Pass

(57) ABSTRACT

A process and apparatus for collecting continuous fibers or filaments as a uniform batt comprises a filament emitter in the form of a spinning die, a venturi, a diffuser, and a fiber collection bed. The filaments move downward after being created by the emitter, and exhaust ports create in the diffuser an airflow having a direction against the flow of the filaments so that the filaments are decelerated before contacting the fiber collection bed.

23 Claims, 5 Drawing Sheets

PROCESS FOR COLLECTION OF CONTINUOUS FIBERS AS A UNIFORM BATT

BACKGROUND

The following description relates to production of fibers into a batt in a continuous process.

Fibrous materials are often produced by passing a fiber-forming, liquified material through apertures to form one or more liquid streams of material. The liquid stream cools, and hardens into a solid filament subsequent to passing out of the aperture. The solid filament may then be collected on a moving screen or porous belt below the location where it was formed, and multiple filaments may be combined and layered to form a batt of material. This batt may then be used for many purposes. For example, when the material is carbon fiber, the batt may be used directly as a structural component in a carbon fiber composite system. The batt may also be chopped, and the resulting pieces may provide structural support in many diverse applications, such as in part of a spray-on carbon fiber system.

Often, the fiber filaments are fairly brittle when they are formed. As a result, the filaments may break in various places as they land on the moving screen or bed. However, it is preferred to have the filaments maintain their integrity, in part because broken filaments provide less structural support when applied, and because broken filaments produce discontinuities in the batt that prevent the batt from being a continuous random collection of filaments, having equal strength and other properties throughout.

Also, multiple continuous fibers may be produced in a line so as to form a curtain, and then laid down on a belt to form a batt. Other layers may then be produced downstream of the first layer to produce an even thicker batt. In some production processes, the batt after being formed is introduced into a furnace in which it is dried. Production of a uniform batt having low bulk density is preferred in such an operation because such a batt allows for relatively quick and even drying.

SUMMARY

This document discloses a method and system for producing fibers from a molten or liquid form in a continuous process to form a batt of material. In one aspect, a device for producing a batt of uniform areal and volumetric density from a spun fiber is disclosed. The device comprises a filament emitter such as a spinning pack with exit orifices such capillaries or spinnerets that emit filaments, a venturi adjacent the capillaries or spinnerets that receives the filaments from the spinning pack, a diffuser near the venturi that receives the filaments from the venturi, one or more air exhaust ports that create in the diffuser an airflow having a direction against the direction of flow of the filaments, and a fiber collection bed that receives the filaments. The bed may comprise, for example, a moving screen.

The diffuser may have two opposing sides that each has an air exhaust port, and the exhaust ports may comprise perforated plates, which may be flat or curved, and may define a plane having a normal axis that intersects a respective filament at substantially a forty-five degree angle. A suction box, which may be equipped with a gas flow straightener, may be mounted below the fiber collection bed, and may be connected to an exhaust fan so as to draw filaments against the fiber collection bed.

The device may be equipped with various air supplies. In one aspect, a primary gas supply may provide gas around the filament at the exit of the capillary or spinneret, and may comprise a pair of opposing gas plenums in the spinning pack. A secondary gas supply, which may comprise a plurality of gas supply ducts having flow straighteners and openings on opposing sides of the filament, may also supply gas around the filament. The diffuser may have a increasing width from a first end near the venturi to a second end distal from the venturi, and the spinning pack may comprise a spinning die having a surface pierced by a plurality of capillaries or spinnerets spaced apart in a line. In another embodiment, the diffuser may have curvilinear walls having an increasing width as compared from a first end near the venturi to a second end distal from the venturi.

In another aspect, a system is described and comprises a plurality of spinning devices, such as four or more devices, that each have one or more spinning packs, a venturi, a diffuser, and one or more exhaust ports in the diffuser. A moving bed having a substantially linear direction of travel may receive filaments, so that filaments from a first spinning device are deposited on the moving bed, and filaments from a successive spinning device are deposited on top of the filaments from the first spinning device. The moving bed may comprise, for example, a perforated belt, and may lie above one or more suction boxes that draw the filaments to the bed. The system may also comprise a fluid supply conduit in communication with each of the plurality of spinning devices. Each spinning pack may comprise a spinning die having a surface pierced by a plurality of capillaries or spinnarets spaced apart in a line, and the devices may be arranged in a line that is perpendicular to the line defined by the capillaries or spinnarets.

A method of producing a fiber batt is also disclosed, and comprises generating a plurality of filaments, directing the filaments downward through a venturi and a diffuser, reducing the plurality of filaments from a first speed to a second speed by passing them through an area having an air flow with an upward component, and depositing the plurality of filaments on a filament bed. The filament bed may be advanced in a linear direction to remove the fiber batt, and the steps above may be repeated to form a second plurality of filaments that are deposited on the bed on top of the other filaments. The filaments may also be cooled from a liquid state to a solid state and attenuated in the venturi.

The details of one or more embodiments of the invention are set forth in the accompanying drawings and the description below. Other features, objects, and advantages of the invention will be apparent from the description and drawings, and from the claims.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
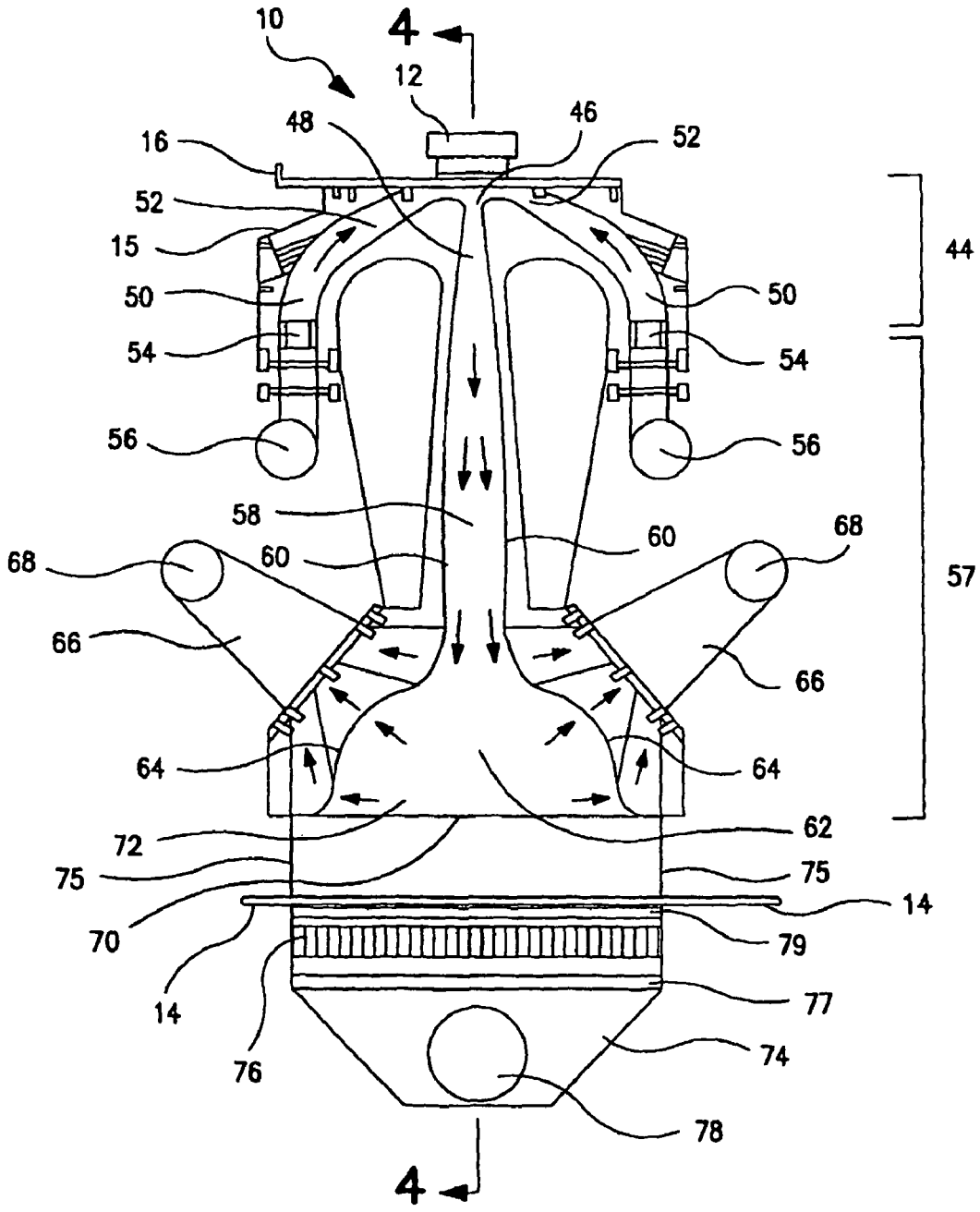
FIG. 1 is a cross-sectional view of a device for collecting continuous blow spun fibers as a uniform batt.
Figure 2:
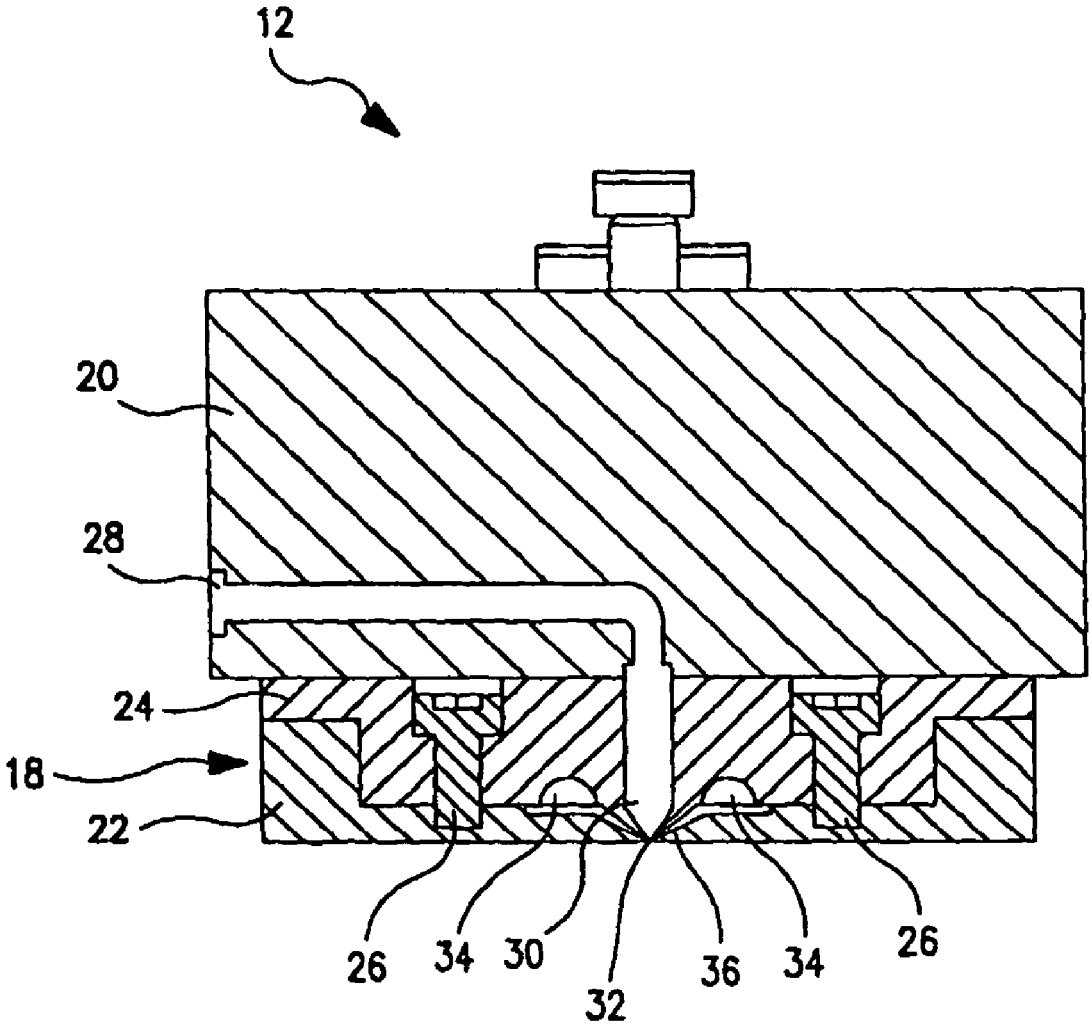
FIG. 2 is an enlarged cross-sectional view of the blow spinning pack of FIG. 1.

FIG. 1 is a cross-sectional view of device 10 for collecting continuous blow spun fibers as a uniform batt. FIG. 2. shows the blow spinning pack 12 of FIG. 1 in more detail in section view. Blow spinning pack 12 has a blow spinning die 18 mounted to a base 20. Blow spinning die 18 comprises a spin tip 24 and cheek plates 22 connected by cheek plate anchor bolts 26. Supply passages 28 receive the fiber melt or polymer and pass it to melt reservoirs 30, so that pitch is expelled through capillary or spinneret exits 32 to form continuous filaments. Multiple capillaries or spinnerets 31 (See FIG. 4) may be provided so that many filaments can be produced simultaneously to form a curtain of filaments. Spinning pack 12 may be heated so as to maintain the fiber melt in a molten state.

Referring to FIG. 2, a primary air supply comprises a pair of primary gas plenums 34 running along the length of blow spinning pack 12 on opposed sides of melt reservoirs 30. The primary gas plenums 34 each have passages or slots 36 that exit adjacent to capillary or spinneret exits 32, so that primary gas is emitted around the filaments as they exit spinning die 18. This primary gas serves to keep the fiber centered after it leaves capillary or spinneret exit 32, and attenuates the resulting filament as it cools and hardens after leaving capillary or spinneret exit 32.

The required temperature of the primary gas is dependent on the melt properties. Some polymers will require the primary gas temperature to be greater than the melt temperature to compensate for the cooling effect of evaporating solvent. For example, if the melt is a solvated mesophase pitch, the primary gas may be provided at a temperature, such as 355° C., that is greater than the melting temperature of the pitch so that the pitch fiber can be attenuated before it is cooled from a molten filament to a solid filament.

Referring again to FIG. 1, blow spinning pack 12 is mounted to the top of housing 15, which receives various filaments and further handles them. The filament enters a passage 44 in housing 15 comprised of a venturi that has a venturi entrance 46 and a venturi throat 48. The venturi entrance 46 is centered beneath the line of capillary or spinneret exits 32 that emit the filaments. Additional gas is provided around the filament from secondary gas supplies 50 that feed into passage 44. This secondary gas (e.g., filtered gas) maintains tension on the filament as it conveys the filament downward. By basic physical principles (e.g., represented by Bernoulli's equation), the gas accelerates as it enters the narrow venturi throat 48, and decelerates where the passage broadens after the venturi throat. The gas may be supplied in a symmetric, pressurized, substantially non-turbulent manner. The two gas flows combine with the filaments near the venturi entrance 46, and form a single, accelerated substantially laminar flow of gas surrounding and entraining the filaments. Because the gas flow is substantially laminar, the filaments may be held relatively straight and stable from the capillaries 32 through the venturi throat 48.

The secondary gas supplies may include gas ducts 52, flow straighteners 54, and gas sources 56. The ducts 52 may take any appropriate form, and may be rectangular in cross-section, particularly where spinning pack 12 has many capillaries or spinnerets in a line, and thus are relatively deep (as measured extending into the page in FIG. 1). Flow straighteners 54 may comprise a grid of plates mounted in the air flow, and gas source 56 may comprise a fan or a gas duct connected to a fan or air pump (such as when multiple devices are used together), or any other appropriate arrangement.

The secondary gas flow helps to further entrain and maintain tension on the filaments. Because it contacts the filaments further downstream than does the primary gas flow it can provide a drag force on the filaments without fear of breaking them. As a result, the secondary gas may be provided at a higher volume than the primary gas and at a higher velocity than the velocity of the filaments.

The distance between capillary or spinneret exit 32 and venturi entrance 46 is determined by the thermosetting characteristics of the spun fiber and the cooling effect of the primary and secondary gas, which determine the quench rate of the particular fiber melt. As used herein, "quenching" refers to the solidification of a fiber. The quench point is that point in fiber formation at which the diameter of the fiber is set and beyond which no additional attenuation, i.e., reduction in diameter, of the fiber will occur. Typically, the distance between capillary or spinneret exit 32 and venture entrance 46 will be a distance of from about 0.25 inches (0.635 cm) to about 100 inches (254 cm). For example, fibers spun from solvated mesophase pitch have a very rapid quench rate and may solidify within a small fraction of an inch of the die tip, i.e., capillary or spinneret exit. Once a pitch carbon fiber has been quenched, its diameter is set and the fiber can no longer be attenuated. The optimal distance between capillary or spinneret exit 32 and venturi entrance 46 for blow spinning fibers from solvated mesophase pitch has been determined to be between about two to four inches (between about 5.08 and 10.16 cm). However, the distance may be even greater than 100 inches (254 cm) for other fiber-forming materials.

Figure 5:
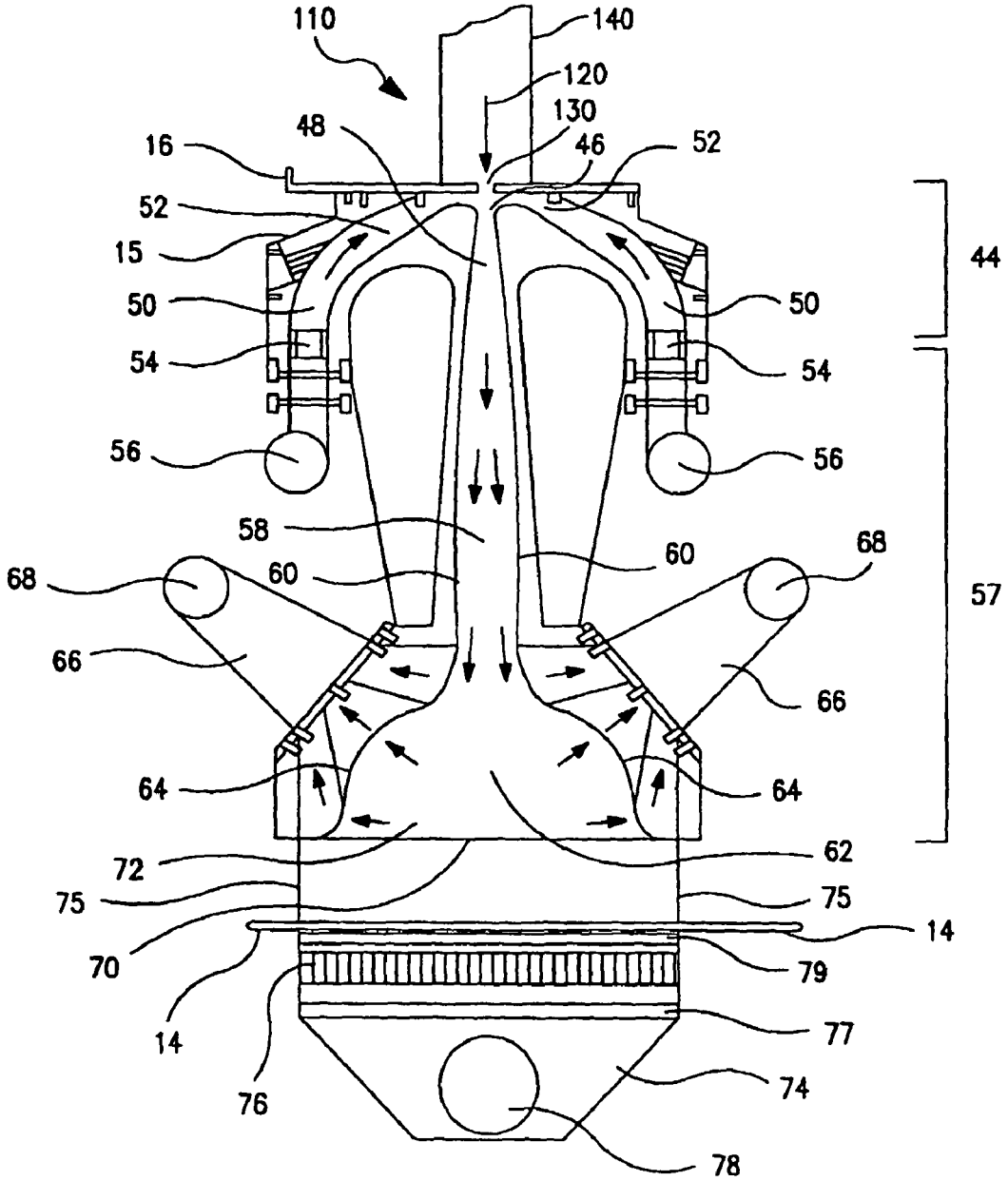
FIG. 5 is a cross-sectional view of a device for collecting continuous fibers as a uniform batt.

For other types of fiber melts, quenching may not occur until after the fiber has entered the venturi and, as a result, the secondary supply air may not only maintain tension on the fibers, it may also result in further attenuation as the fiber passes through the venturi and the first part of the diffuser. As will be recognized by one skilled in the art, it may be desirable to increase the distance between spin pack 12 and venturi entrance 46 and still maintain a closed environment. Housing 15 may be extended in an upwards direction to further separate spin pack 12 and venturi entrance 46, as illustrated in FIG. 5.

After the filament has passed through the venturi, it may enter a diffuser 57, which widens from the top to the bottom. The boundary between the venturi and the diffuser may be considered to be at any appropriate point. For example, the venturi may be considered to end at the minimal width of the venturi throat 48, and the diffuser may be considered as the remaining portion of passage 44. Also, the venturi could be considered as comprising a portion of the widening section of passage 44, with the diffuser comprising the remainder of passage 44.

The diffuser 57 comprises an upper portion 58, a lower portion 62 and an exit 70. Upper portion 58 may be a widening portion of passage 44 defined by opposing diffuser walls 60. Because upper portion 58 increases in size from top to bottom, the vertical velocity of the air will slow from the top to the bottom of upper portion 58, and the vertical velocity of the filaments will also slow, with the filament beginning to move horizontally to accommodate its relatively high speed at the top and its relatively low speed at the bottom of upper portion 58. As shown in FIG. 1, diffuser walls 60 may be curved and the distance between diffuser walls 60 increases at a rate that allows a controlled expansion of the gas. This helps prevent separation of the gas stream from walls 60 and prevents the creation of backflows or eddy currents, or turbulent flow that would cause the filaments to entangle with one another and form non-uniform bundles or clumps.

Diffuser 57 includes a lower portion 62, which may be in the form of a bell or skirt, in which a portion of the gas from passage 44 is separated from the downward flow of the filaments. One or more exhaust ports 64 on each side of lower portion 62 are oriented so that exhaust air is drawn from lower portion 62 and into exhaust plenums 66 in a generally horizontal and upward direction, as generally indicated by flow arrows in the figure. Exhaust ports 64 may simply be open areas in the walls of lower portion 62, or may comprise screens, perforated flexible plates, or other suitable configurations. Exhaust gas may be conveyed by a relative vacuum that is created in lower portion 62 by the removal of gas from exhaust ducts 68. Exhaust ducts 68 may be connected to an exhaust fan, or may connect to a central duct system that serves multiple devices. Likewise, exhaust gas may be recirculated from exhaust duct 68 to supply duct 56.

In FIG. 1, the walls of lower portion 62 are configured to provide a smooth transition from the upper portion of diffuser 57, and then curve outward to provide a horizontal component and a greater upward vertical component to the exhaust gas flow velocity in the lower portion of diffuser 57. In this manner, the horizontal component of the exhaust further spreads the flow of gas and thus slows it, and allows the flow to spread from side to side of the lower portion 62, which causes the fiber to spread even more. The upward component of the exhaust also imparts an upward force on the falling filaments, and causes them to slow even more before they land on collecting surface 14. The velocity of the exhaust gas may be controlled so that the filaments are not pulled into exhaust ports 64, but are instead only spread horizontally. As a result, the filaments experience a relatively soft landing on collecting surface 14, and are less likely to crack, fracture, or otherwise be damaged. They also form a more even and random batt. Exhaust port 64 may also take other configurations, such as by being formed as perforated plates in lower portions of walls 60. Also, exhaust ports 64 may have vertical surfaces so that they create only a horizontal flow of gas. Other appropriate configurations may also be used.

Filaments collect in a relatively random batt as they land on collecting surface 14. Collecting surface 14 moves under diffuser exit 70. Collecting surface 14 may be perforated, or otherwise porous or interrupted, to allow gas to be exhausted into vacuum box 74 below collecting surface 14. For example, collecting surface 14 may comprise a series of linked bars, a screen, or other appropriate arrangement.

Positioned under collecting surface 14 is vacuum box 74. Vacuum box 74 may be the same size and shape as diffuser exit 70, and may be provided with a flow straightener 76 and a perforated plate 77 that produces a more laminar and even flow of gas through collecting surface 14. As with the other components that supply or exhaust gas, vacuum box 74 may be connected to a fan by duct 78 or by one or more ducts to other vacuum boxes if device 10 is one of multiple devices in a larger system. Where a system has multiple devices 10, a single vacuum box or a segmented vacuum box, or other structure for providing a negative pressure to hold the batt to collecting surface 14, may be provided. Also, the batt may be held in place with pressure from above, where appropriate.

The volume of the flow through vacuum box 74 may be adjusted with the spacing between diffuser exit 70 and collecting surface 14, the volume of gas supplied through venturi throat 48, and the volume of gas exhausted through exhaust ports 64. The balancing parameters may be selected so that filaments land on collecting surface 14 at a rate at which they fall evenly and will not be substantially damaged, and so that there is sufficient suction provided by vacuum box 74 so that the batt is held to collecting surface 14 and can be carried away as collecting surface 14 moves underneath diffuser exit 70. The diffuser exit 70 and the vacuum box 74 may also be sized so that the gas and filaments are slowed sufficiently so that the filaments can be deposited on collecting surface 14 in a loose, low-density, continuous fiber batt of substantially randomly-oriented filaments. Baffles 75 may also be provided, and configured to allow the fiber batt to pass freely out of device 10, but to maintain a proper pressure relationship with the surrounding area. In general, the flow of gas may be balanced so that the total gas removed through vacuum box 74 and exhaust ports 64 is equal to the total gas volume through the venturi so that the system is neutral with respect to its environment.

Pressure monitors, flow monitors and control valves (not shown) are provided to monitor and control the supply and exhaust air to obtain the proper pressure relationships to obtain the desired areal ($g/m^2$) and volumetric density ($g/m^3$) of the fiber batt. One skilled in the art will appreciate that increasing the speed of the collecting bed or decreasing the spinning rate will decrease the areal density of the batt. Similarly the volumetric density of the batt can be increased by increasing the ratio of the exhaust air through vacuum box 74 to the supply air and decreased by increasing the ratio of the supply air to the exhaust air. Control of both the areal and volumetric density may be desirable for certain applications. For example, low density batts may be desirable to facilitate drying, solvent removal, heat treatment or the application of sizings. Alternatively, high density fiber batts are desirable for use in composite reinforcement applications.

Removable perforated plates or screens 79 may be provided beneath collection surface 14 to remove or filter out any broken fibers and fiber particles that are pulled through collection surface 14 with the exhaust gas flow. These plates or screens are designed to provide uniform gas flow over the entire surface of suction box 74 and contribute to the formation of a uniform batt. Screens 79 may be removed and brushed or vacuum cleaned during the operation of the spinning and fiber collection process. Screens 79 prevents broken fibers from plugging flow straightener 76 and perforated plate 77 and enables the fiber collection process to operate continuously with uniform and constant exhaust gas flow over the surface of suction box 74.

Device 10 may be provided with a back wall 72 and a front wall (not shown) to serve as covers to enclose passage 44. The walls may be, for example, flat panels that can be mounted to housing 15 to create an entire enclosed housing. In this manner, the walls may also be removed to permit access to the inside of housing 15 for cleaning, maintenance, and other needs. The walls may be spaced according to the length of spinning pack 12 so that all of the capillaries or spinnerets 31 emit fibers inside the enclosed space. Where multiple spin packs are used instead of a single long one, dividers 81 (See FIG. 4) may also be used in parts of passages 44 and diffuser 57 to separate one blow spinning pack from another, for example to allow isolation and replacement of a particular spinning pack without disturbing adjacent spinning packs. Sliding panel 16 may also be provided between blow spinning pack 12 and housing 15. Panel 16 may be moved into position to block the flow of filaments out of blow spinning pack 12, such as when production is stopped on device 10. In addition, it may be necessary to conduct cleaning and other maintenance on blow spinning pack 12, and panel 16 may prevent contaminants from entering passage 44 during that process.

By way of a non-limiting example, a blow spinning die such as spinning die 18 may produce pitch carbon fibers from solvated mesophase pitch at a speed of 50 m/sec. By controlling the rate of supply of the secondary gas through secondary gas supply 50, the amount of air exhausted through the exhaust air plenum 66, and the amount of air exhausted through vacuum box 74, the speed at which the fiber impacts on collection surface 14 can be reduced to 1 m/sec.

Figure 3:
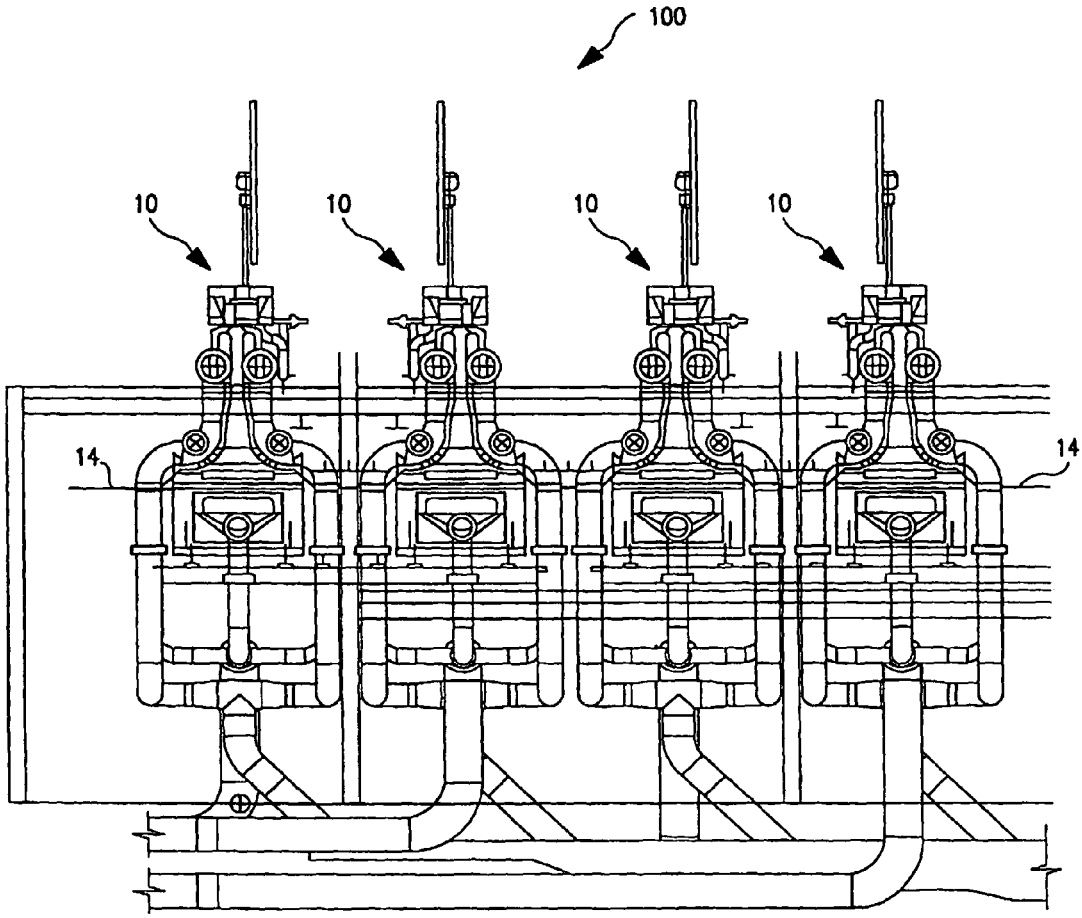
FIG. 3 is a cross-sectional view of a system for producing a multiple layer uniform fiber batt from continuous blow spun fibers.

FIG. 3 is a cross-section view of several devices 10 in a system 100 for producing a uniform multi-layer fiber batt. As shown, the left-most device 10 may first deposit a batt onto collection surface 14, which moves the batt from left to right. The next device 10 may then lay down another layer of batt, and so on until a four-layer batt emerges at the right of system 100. The multi-layer batt, depending on the type of fiber and the desired end product or use, may then be either used as produced or subjected to additional processes downstream, for example, drying to remove any solvents remaining in the fiber, stabilization, carbonization, graphitization or needling.

Figure 4:
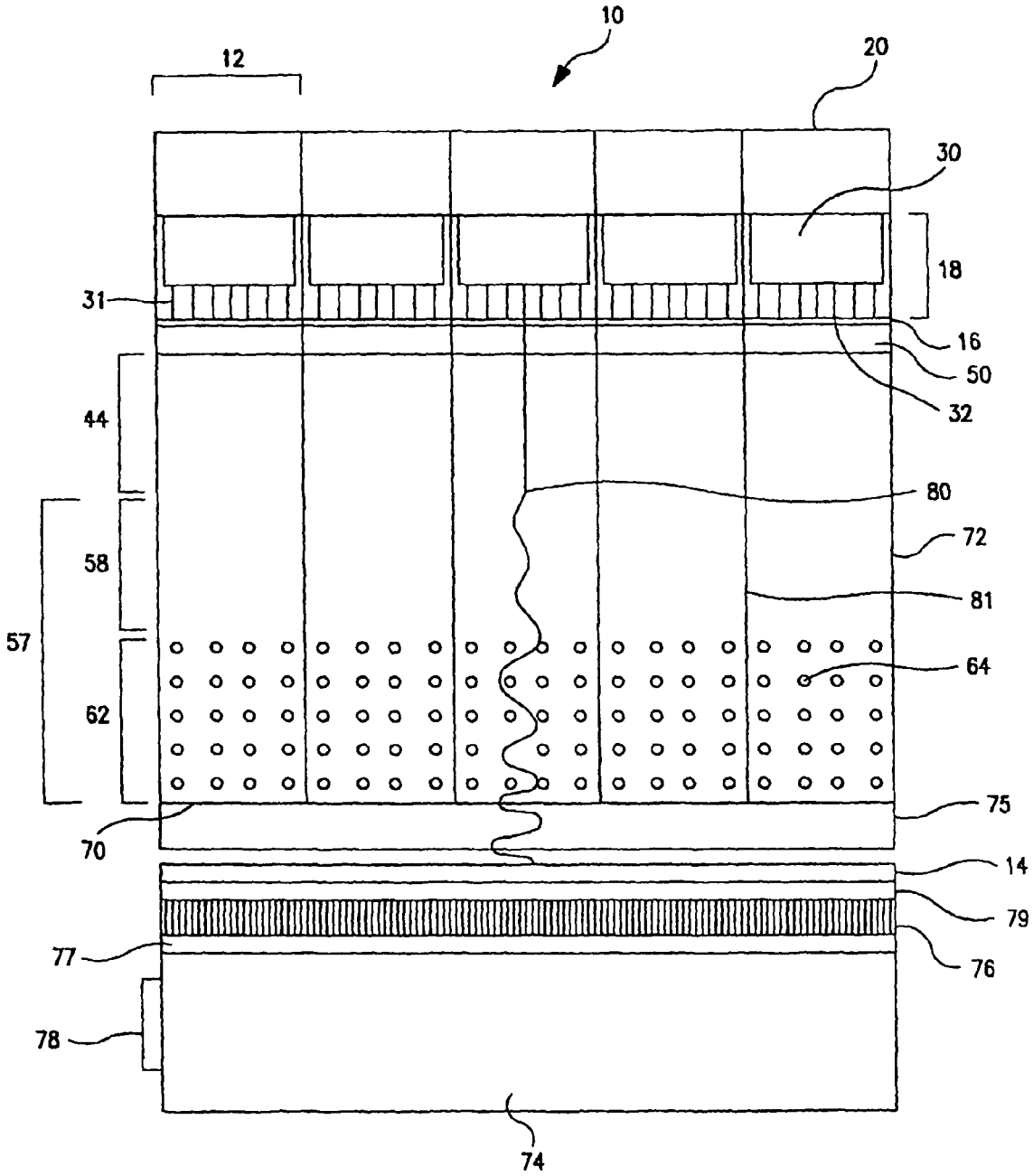
FIG. 4 is a longitudinal cross-section of a device for collecting continuous blow spun fibers as a uniform batt taken along line 4-4 in FIG. 1.

FIG. 4 is a longitudinal cross-section of device 10 as viewed along line 4-4 in FIG. 1. where system 10 contains multiple spin packs 12. In this view, collecting surface 14 is moving into the page. Fibers 80 exit capillaries or spinnerets 31 via exits 32 and enter passage 44. In this figure, exhaust ports 64 in the lower portion 62 of diffuser 57 are depicted as a perforated plate. As fiber 80 moves downward, the upward component of the air flow in lower portion 62 slows the downward velocity of the fiber. If collecting surface 14 is moving at a speed slower than the speed of fiber 80 as it nears collection bed, the fiber will move horizontally over collecting surface 14. Dividers 81 may be provided in passage 44, and optionally in diffuser 57, to separate spinning packs 12 to allow isolation of a particular spin pack without disturbing adjacent spinning packs.

FIG. 5 is a cross-sectional view of a device 110 for collecting pre-formed continuous fibers as a uniform batt. The fibers may be, for example, continuous blow spun or melt spun fibers which have been passed through a tensioning device before being introduced into device 110. Alternatively the fibers may be pre-formed fibers stored on a suitable device, for example a spool or a bobbin, which are unwound just prior to introduction into device 110. Fibers (indicated by arrow 120) are introduced at the top of the device 110 through aperture 130 in housing 15 and are advanced through venturi entrance 46. After entering venturi entrance 46, the process and apparatus are the same as described in FIG. 1. Additional ancillary equipment which may be required but is not shown may include mechanical spool or bobbin unwinders or fiber tensioning devices. Such items are well known to those skilled in the art.

Housing 15 may have an upward extension 140 to provide an enclosed environment around the fibers when it is desirable to increase the distance between the exit of a fiber from a fiber forming device, e.g., a melt spinning die (not shown), and venturi entrance 46. Sliding panel 16 and aperature 130 may be located at either the bottom or top of upward extension 140.

A number of embodiments of the invention have been described. Nevertheless, it will be understood that various modifications may be made without departing from the spirit and scope of the invention. For example, although the invention has been described with reference to use of a blow spinning die, the invention is equally applicable to fiber spinning systems which utilize melt spinning dies, or to systems where batts are made from fibers or yarns which have been spun and stored on devices such as spools or bobbins. Accordingly, other embodiments are within the scope of the following claims.

We claim:

1. A process for preparing a fiber batt from blow spun fibers comprising:

a) heating a spinnable substance to a temperature sufficient to allow the spinnable substance to flow;

b) forming at least one fiber by passing the spinnable substance into a spinning apparatus and through at least one capillary located within the spinning apparatus, wherein said at least one fiber has an initial velocity;

c) contacting said at least one fiber with at least one flowing stream of gas;

d) contacting said at least one fiber with at least one additional flowing stream of gas to place said fiber under tension, wherein the velocity of said at least one additional flowing stream of gas is greater than said initial velocity of the at least one fiber;

e) passing said at least one fiber and said additional flowing stream of gas into a venturi;

f) thereafter passing said at least one fiber into a diffuser, comprising an upper portion and a lower portion, wherein the diffuser is shaped so that its walls curve outwards to provide for a horizontal component and an upward vertical component to the gas flow thereby dissipating the at least one additional flowing stream of gas to reduce the velocity of the at least one additional flowing stream of gas thereby reducing the velocity of the at least one fiber to a final velocity;

g) passing said at least one fiber out of said diffuser at said final velocity; and, h) collecting said at least one fiber to form a fiber batt.

2. The process of claim 1, further comprising controlling the rate of dissipating said at least one additional stream of gas, by provision of exhaust ports located within the diffuser, wherein the exhaust ports are positioned to draw gas from the lower portion of the diffuser and so provide upward and horizontal components to an exhaust gas stream thereby controlling the final velocity of the at least one fiber.

3. The process of claim 2 wherein the rate of dissipation of said at least one additional stream of gas is increased to effectuate an increase in the volumetric density of the fiber batt.

4. The process of claim 2 wherein said initial velocity of the at least one fiber as it exits said spinning apparatus is reduced to said final velocity when it exits the diffuser and wherein the ratio of said initial velocity to said final velocity is up to 50:1.

5. The process of claim 1, wherein said at least one fiber is spun from a carbonaceous pitch.

6. The process of claim 1, wherein said at least one fiber is spun from a solvated mesophase pitch.

7. The process of claim 1, further comprising controlling the velocity of said at least one fiber in the diffuser by provision of exhaust ports located within said diffuser positioned to draw gas from the lower portion of the diffuser and so provide upward and horizontal components to an exhaust gas stream thereby controlling the final velocity of the at least one fiber.

8. The process of claim 7 wherein control of the final velocity of said at least one fiber is affected by control of the amounts of gas exhausted through said exhaust, the amount of gas exhausted through a collection plate and the amount of additional gas fed into the venturi.

9. The process of claim 8 wherein said initial velocity of the at least one fiber as it exits said spinning apparatus is reduced to said final velocity when it exits the diffuser and wherein the ratio of said initial velocity to said final velocity is up to 50:1.

10. The process of claim 7, wherein the exhaust ports comprise one or more openings in the opposing walls of the lower portion of the diffuser.

11. The process of claim 10, wherein the exhaust ports comprise perforated plates.

12. The process of claim 1, wherein the venturi and the diffuser have opposing walls centered about an axis drawn vertically through the center of the venturi.

13. The process of claim 12, wherein the distance between the axis and the opposing walls of a second open end of the venturi is greater than the distance between the axis and the opposing walls of a first open end of the venturi.

14. The process of claim 12, wherein the distance between the axis and the opposing walls of a second open end of the diffuser is greater than the distance between the axis and the opposing walls of a first open end of the diffuser.

15. The process of claim 12, wherein at least a portion of the opposing walls of the upper portion of the diffuser curve in an outward direction relative to the axis.

16. The process of claim 12, wherein at least a portion of the opposing walls of the lower portion of the diffuser curve in an outward direction relative to the axis.

17. The process of claim 2, wherein the exhaust ports comprise one or more openings in the opposing walls of the lower portion of the diffuser.

18. The process of claim 17, wherein the exhaust ports comprise perforated plates.

19. The process of claim 1, wherein the fibers are collected on a collecting surface.

20. The process of claim 19, further comprising exhausting air beneath the collecting surface.

21. The process of claim 1, wherein the venturi and the diffuser are contiguous.

22. The process of claim 1, wherein the distance between the second opening of the capillary and the first open end of the venturi is from about 0.25 inches (0.635 cm) to about 100 inches (254 cm).

23. The process of claim 22, wherein the distance between the second opening of the at least one capillary and the first open end of the venturi is from about 2 inches (5.08 cm) to about 4 inches (10.16 cm).

* * * * *